US005809460A

United States Patent [19]

Hayata et al.

[11] Patent Number: 5,809,460

[45] Date of Patent: Sep. 15, 1998

[54] SPEECH DECODER HAVING AN INTERPOLATION CIRCUIT FOR UPDATING BACKGROUND NOISE

[75] Inventors: Toshihiro Hayata; Yoshihiro Unno, both of Tokyo, Japan

[73] Assignee: NEC Corporation, Tokyo, Japan

[21] Appl. No.: 337,010

[22] Filed: Nov. 7, 1994

[30] Foreign Application Priority Data

Nov. 5, 1993 [JP] Japan ..... 5-276603

[51] Int. Cl.[6] ..... G10L 5/00

[52] U.S. Cl. ..... 704/225; 704/228; 704/265

[58] Field of Search ..... 395/2.34, 2.37, 395/2.74

[56] References Cited

U.S. PATENT DOCUMENTS

| | | | |
|---|---|---|---|
| 4,435,832 | 3/1984 | Asada et al. | 381/34 |
| 4,630,305 | 12/1986 | Borth et al. | 381/94 |
| 4,937,873 | 6/1990 | McAulay et al. | 381/51 |
| 5,146,504 | 9/1992 | Pinckley | 381/46 |
| 5,432,859 | 7/1995 | Yang et al. | 381/94 |

FOREIGN PATENT DOCUMENTS

| | | |
|---|---|---|
| 58-171095 | 10/1983 | Japan . |
| 60-262200 | 12/1985 | Japan . |
| 61-272800 | 12/1986 | Japan . |
| 2 98243 | 4/1990 | Japan . |
| 2294699 | 12/1990 | Japan . |

OTHER PUBLICATIONS

Recommendation GSM 06.12, "Comfort Noise Aspects for Full–Rate Speech Traffic Channels," ETSI/PT 12, pp. 1–6, Feb. 1992.

GSM Recommendation: 06.10, "GSM Full Rate Speech Transcoding," ETSI/GSM, pp. 1–93, Jan. 1990.

GSM Recomendation 06.31 and 06.10, released by ETSI/PT 12, Jan. 1990.

Chapter 5 of Sadaoki Furui, "Digital Speech Processing", Tokai University Publication Center, 1st Ed., Sep. 25, 1985.

*Primary Examiner*—Curtis A. Kuntz
*Assistant Examiner*—Vijay B. Chawan
*Attorney, Agent, or Firm*—Sughrue, Mion, Zinn, Macpeak & Seas, PLLC

[57] ABSTRACT

In a LPC speech signal decoder, background noise is simulated during periods of silence at the transmitting end based upon a background noise frame containing information about the background noise at the sending end. When the silence persists, the transmitter periodically updates the background noise frame previously send by transmitting an updating background noise frame. When an update background noise frame is received, an interpolation is performed so as to make the simulated background noise sound natural to the listener. The interpolation process includes a step of selecting between interpolation spectrum parameters which are produced by the interpolation process and the updated spectrum parameters which are based solely upon the most recent updated background noise frame.

7 Claims, 5 Drawing Sheets

CONTROL FLOW OF INTERPOLATION CIRCUIT

SPEECH DECODER HAVING AN INTERPOLATION CIRCUIT FOR UPDATING BACKGROUND NOISE

BACKGROUND OF THE INVENTION

1. Field of the Invention

The present invention relates to a speech decoder in a speech transmission system of a type in which transmission power is controlled at the transmission side in accordance with voice activity and, more specifically, to an improvement of a speech decoder which generates background noise in a silence state.

2. Description of the Prior Art

In the field of speech transmission, the Voice-Operated Transmitter (VOX) or Discontinuous Transmission (DTX) is employed to save power consumption and reduce the level of interference waves. In both of these, the transmission power is controlled depending on whether an input voice signal comprises speech or silence. (Refer to GSM Recommendation 06.31 and 06.10, released by ETSI/PT 12, Jan. 1990.)

At a transmission side employing VOX or DTX, an input voice signal is separated into speech spectrum coefficients and the other components comprising its pitch frequency, voice power, and sound source components, each of which is encoded on a frame-by-frame basis to be transmitted. In this operation, if the input voice signal is judged to be of silence, the background noise frame at that time is transmitted and then transmission is suspended for a predetermined period (a predetermined number N of frames) unless the input voice signal turns to speech. If the input signal has not turned to speech even after the lapse of the N-frame period, the transmission side updates the background noise by again transmitting a background noise frame at that time. If the input voice signal turns to speech and then returns to silence before a lapse of the N-frame period, the background noise frame immediately before the input voice signal turns to speech is again transmitted. (Refer to GSM Recommendation 06.31 mentioned above, page 10, FIGS. 2 and 3.) If the input voice signal turns to speech during the suspension of transmission, the transmission side is immediately returned to a speech operation.

The receiving side generates a voice signal by decoding a received code string. While code transmission is suspended, the receiving side generates background noise of silence by repeatedly decoding the code string of the background noise frame that was received immediately before the transmission suspension. To prevent the background noise from becoming too unnatural, the decoding is performed with parameters of the background noise partially changed every frame.

FIG. 1 is a block diagram showing an example of a conventional speech decoder. Receiving code strings from a receiver system 1, an excitation signal generator 2 and a speech spectrum coefficient generator 3 generate excitation signal ex and speech spectrum coefficients sp, respectively. A speech synthesis filter 4 generates a voice signal by combining the excitation signal ex and the speech spectrum coefficients sp, and supplies the generated voice signal to an output circuit 5.

As described above, when the transmission has been suspended for the N-frame period by the transmission side judging that the input voice signal is of silence, the (N+1)th frame is transmitted as updated background noise. The receiver system 1 receives and stores a code string of the updated background noise, and the speech decoder repeatedly synthesizes and outputs a voice signal for the new background noise.

Speech spectrum coefficients are coefficients representing a spectrum that characterizes a voice. Since the speech spectrum coefficients are defined as coefficients that represent a spectrum envelope in the above-mentioned GSM Recommendation, the following description is directed to coefficients representing a spectrum envelope as an example of speech spectrum coefficients. The coefficients representing a spectrum envelope includes Linear Prediction Coding (LPC) coefficients, Partial Autocorrelation (PARCOR) coefficients, and Line Spectrum Pair (LSP) coefficients, etc. These types of coefficients are described in detail in chapter 5 of Sadaoki Furui, "Digital Speech Processing" (in Japanese), Tokai University Publication Center, 1st ed., Sep. 25, 1985.

In the above-described conventional speech decoder, when a silent state continues for a long time, the background noise generated at the receiving side is updated by only a code string that is received from the transmitter every N frames. Therefore, at the time of updating, there occurs an abrupt transfer from the N-frame prior background noise to the new background noise, as shown in FIG. 5. If there occurs a variation in the characteristics of the background noise during the N-frame period, a person on the receiving side recognizes the abrupt change of the background noise at the time of updating. Furthermore, if the background noise changes over a long period, the abrupt change of the background noise is recognized every N frames. This is one of the factors that cause a person on the receiving side to feel unnatural noise changes.

Japanese Unexamined Patent Publication No. Sho 58-171095 discloses a technique for suppressing noise in a silent state at a transmission side. More specifically, when a decision that a voice signal is of silence is made due to small spectrum values and noise is detected, the amplitude of the voice signal is made 0.

Japanese Unexamined Patent Publication No. Sho 60-262200 discloses a technique for removing unnaturalness that may occur between frames. More specifically, interpolation is suspended in frames in which a first-order spectrum coefficient greatly changes toward the negative side, and interframe interpolation is performed in the remaining frames.

Japanese Unexamined Patent Publication No. Sho 61-272800 discloses a technique in which an average spectrum envelope parameter and a residual spectrum envelope parameter are extracted by using analysis windows having different lengths, and a spectrum envelope parameter of a voice is expressed by these two parameters.

Japanese Unexamined Patent Publication No. Hei 2-98243 discloses a technique for reducing the deterioration in voice quality due to waveform discontinuities at block boundaries.

Further, Japanese Unexamined Patent Publication No. Hei 2-294699 discloses a technique of preventing a deterioration in voice quality due to a waveform amplitude distortion by specifying an equivalent bandwidth in smoothing a spectrum by use of a lag window in a speech analysis scheme based on a multiple pulse sound source driving method.

However, none of the above techniques can remove unnaturalness that may occur in background noises when a silent state continues for a long time.

SUMMARY OF THE INVENTION

An object of the present invention is to provide a speech decoder which can generate natural background noise even when a silent state continues for a long time.

In a speech decoding device according to the present invention, when updated background noise is received, a predetermined period from the time point of the updating is made an interpolating operation period. In this interpolation period, interpolation parameters are sequentially generated so that parameters for synthesizing background noise are gradually changed from old parameters to updated parameters.

The speech decoding device according to the invention is comprised of a buffer memory and a interpolation circuit. The buffer memory stores preceding parameters corresponding to the frame preceding a current frame. The interpolation circuit generates interpolation parameters in frames over the interpolation period, the interpolation parameters changing in magnitude by a predetermined step from the preceding parameters stored in the buffer memory to the updated parameters corresponding to the current frame.

Preferably, the interpolation circuit is comprised of an interpolation parameter generator and a selector. The interpolation parameter generator generates the interpolation parameters over the interpolation period. The selector selects either the interpolation parameters or the current parameters such that the interpolation parameters is selected during the interpolation period and the current parameters is selected during periods other than the interpolation period.

DETAILED DESCRIPTION OF THE PREFERRED EMBODIMENTS

A transmission side is comprised of a system employing VOX or DTX as mentioned above. Therefore, the transmission side determines whether an input voice signal is of speech or silence, and controls transmission power based on the result of this decision. The input voice signal is separated into speech spectrum coefficients and other components (a pitch frequency, voice power, and a sound source component), each of which is encoded on a frame-by-frame basis to be transmitted together with information indicating whether the input voice signal is of speech or silence. In this operation, if the input voice signal is determined to be of silence, a background noise frame at that time is transmitted and then the transmission is suspended for an N-frame period. After the lapse of the N-frame period, the transmission side updates the background noise by again transmitting a background noise frame at that time, and then the transmission is suspended for an N-frame period. Such an operation is performed repeatedly. An update signal is transmitted when the background noise is updated. If the input voice signal turns to speech and then turns to silence before the lapse of an N-frame period, the background noise frame immediately before the input voice signal turns to speech is again transmitted. If the input voice signal turns to speech during suspension of the transmission, the transmission side is immediately returned to a speech operation.

Figure 1:
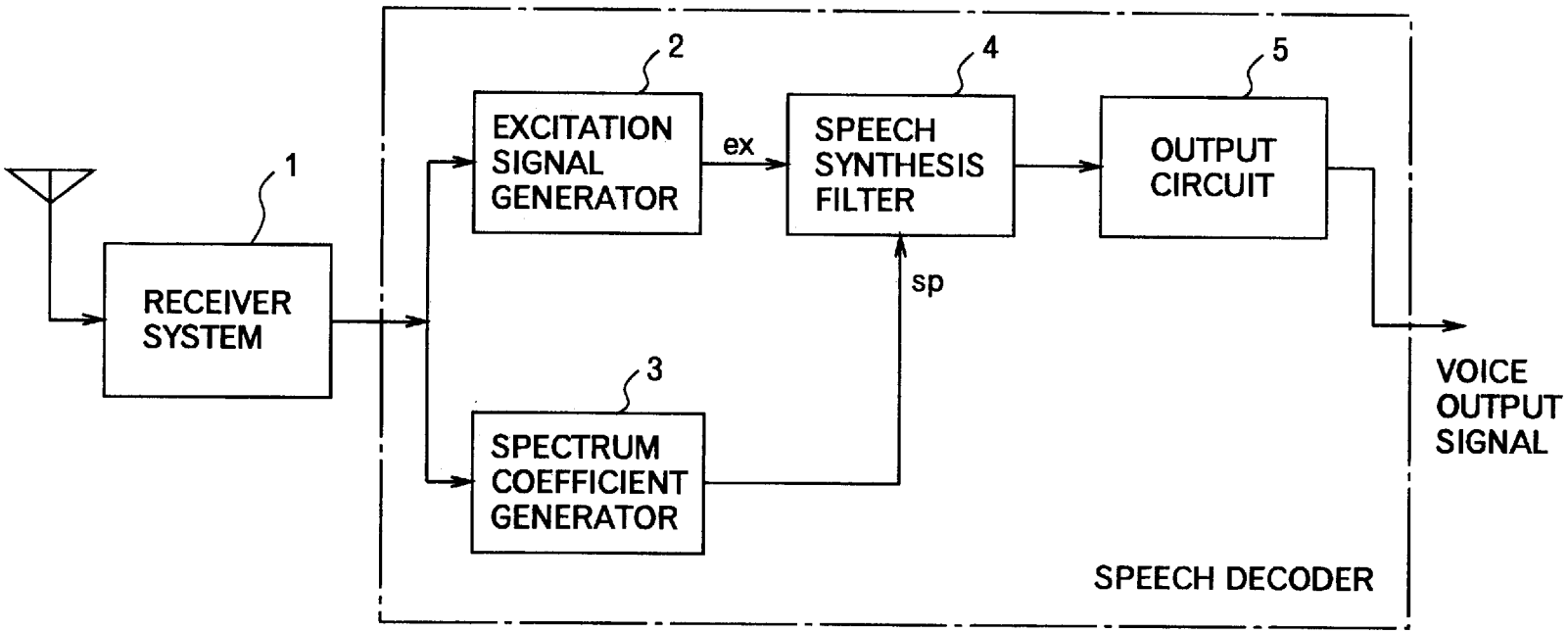
FIG.1 (PRIOR ART)
FIG. 1 is a block diagram showing a conventional speech decoder.
Figure 2:
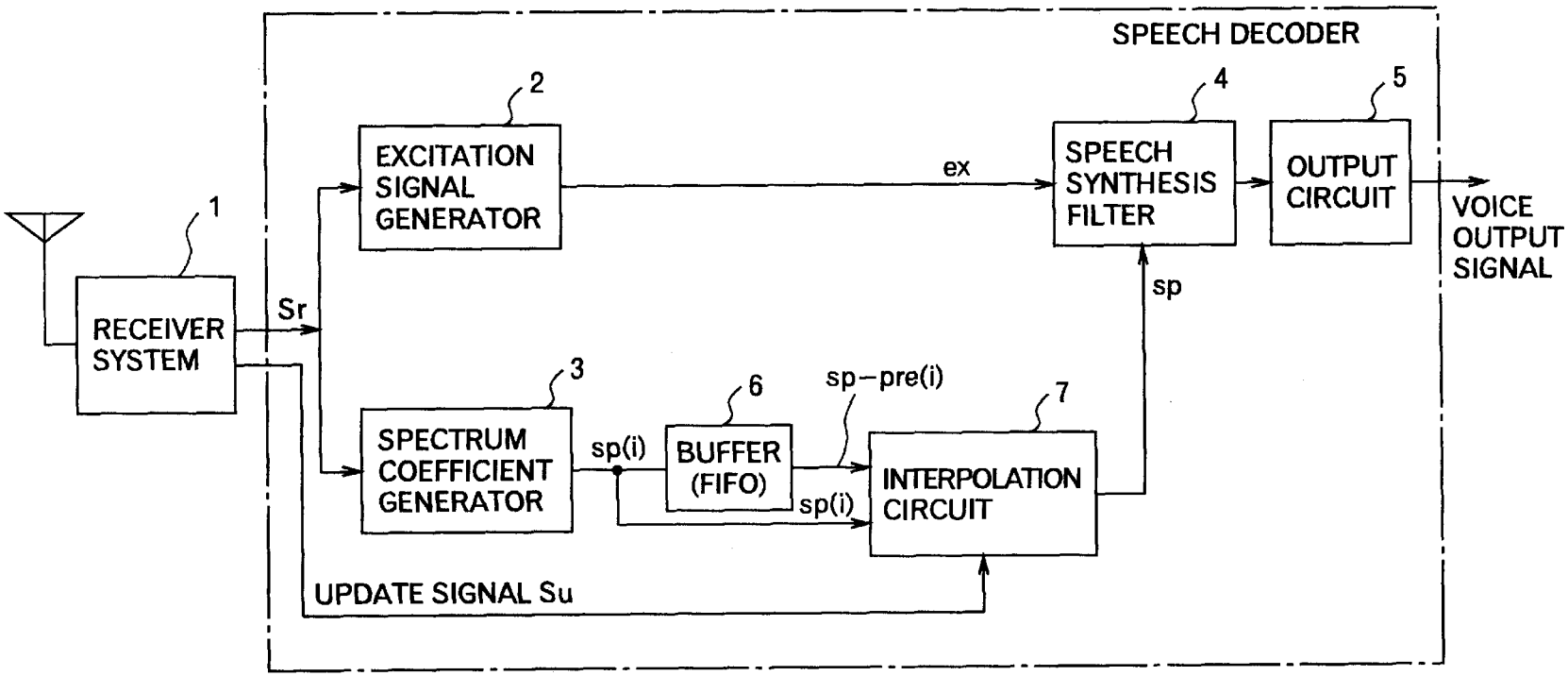
FIG. 2 is a block diagram showing a speech decoder according to an embodiment of the present invention.

As shown in FIG. 2, supplied with encoded signal Sr and background noise update signal Su that have been reproduced by a receiver system 1, a speech decoder on the receiving side performs a decoding operation in the following manner: Encoded signal Sr is supplied to an excitation signal generator 2 and a spectrum coefficient generator 3, which generate excitation signal ex and voice spectrum coefficients sp, respectively. The excitation signal generator 2 generates excitation signal ex based on the received pitch frequency, voice power, and sound source component.

Speech spectrum coefficient sp(i) is transferred from the spectrum coefficient generator 3 to a buffer 6 and an interpolation circuit 7, where the numeral i indicates the degree of a speech spectrum coefficient of each frame. If the number of speech spectrum coefficients of a frame is n, the numeral i is any integer in the range from 1 to n.

The buffer 6 is capable of storing speech spectrum coefficients sp of a frame. Preferably, the buffer 6 is of a first-in first-out (FIFO) type. Therefore, an output coefficient sp-pre (i) of the buffer 6 is the speech spectrum coefficient corresponding to sp(i) in the preceding frame.

Receiving a current frame speech spectrum coefficient sp(i) and an one-frame-prior speech spectrum coefficient sp-pre(i), an interpolation circuit 7 performs an interpolation operation in accordance with the update signal Su that is sent by the receiver system 1, and supplies interpolation spectrum coefficients sp to a speech synthesis filter 4. During periods other than the periods of the interpolation operation, the interpolation circuit 7 forwards the speech spectrum coefficient sp(i) that are received from the spectrum coefficient generator 3 to the speech synthesis filter 4 without any process, as in the case of the conventional decoder. Therefore, in ordinary periods, speech spectrum coefficients sp that are provided to the speech synthesis filter 4 are speech spectrum coefficients indicated by sp(i) which are the same as in the conventional decoder. However, in background noise updating periods, they are switched to interpolation spectrum coefficients. The interpolation circuit 7 will be described below in further detail.

Figure 3:
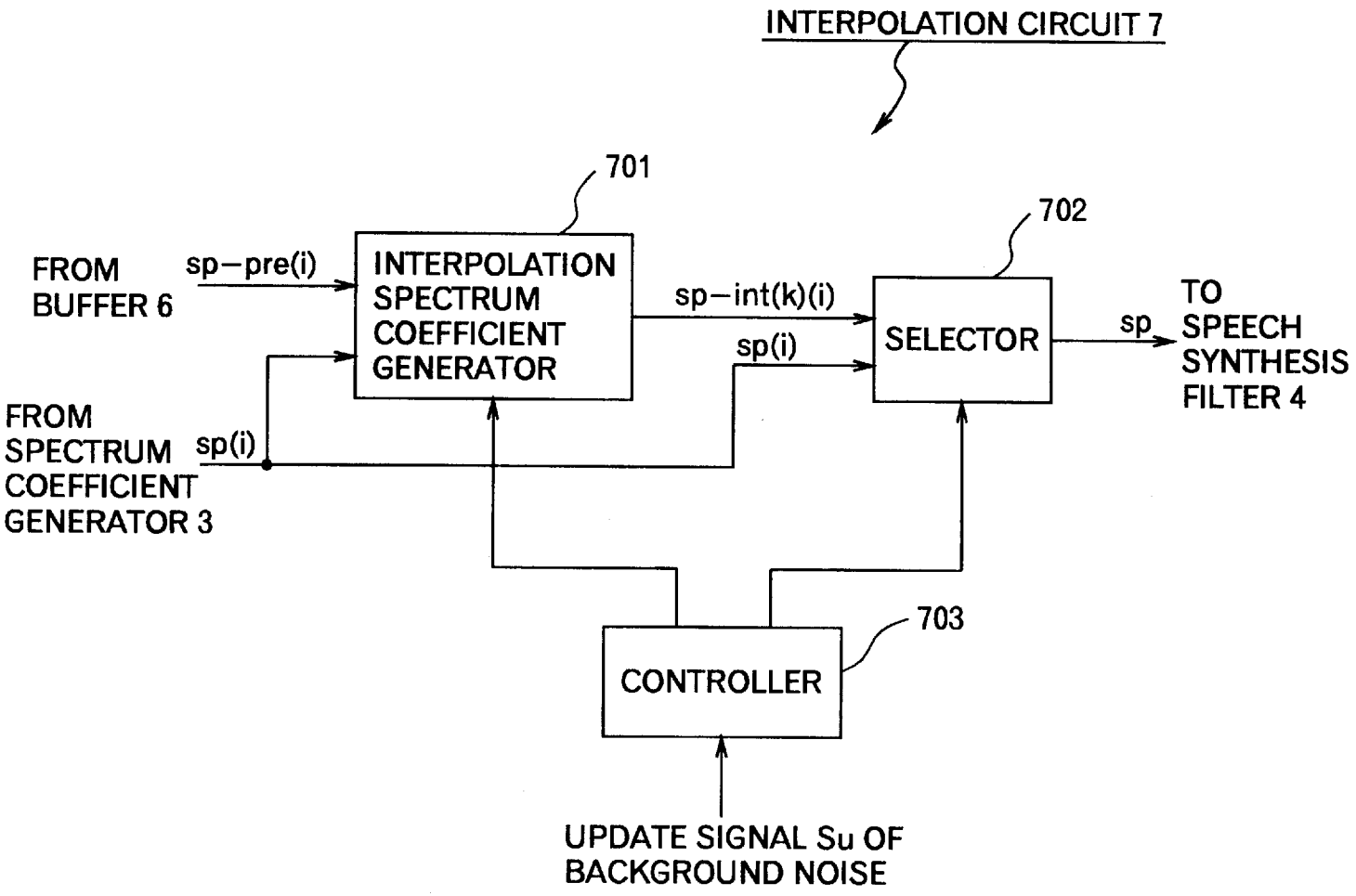
FIG. 3 is a detailed block diagram showing an interpolation circuit of the embodiment.

As illustrated in FIG. 3, the interpolation circuit 7 is comprised of an interpolation spectrum coefficient generator 701, a selector 702 for selecting one of an interpolation spectrum coefficient sp-int(k)(i) and a speech spectrum coefficient sp(i), and a controller 703 for controlling the interpolating operation.

The interpolation spectrum coefficient generator 701 generates an interpolation spectrum coefficient sp-int(k)(i) based on an one-frame-prior spectrum coefficient sp-pre(i) received from the buffer 6 and a current frame spectrum coefficient sp(i) received from the spectrum coefficient generator 3, where k means a frame number in an interpolation operation period. If an interpolation operation period consists of m frames, k is any integer in the range from 0 to m−1. As k increases from 0 to m−1, an interpolation spectrum coefficient sp-int(k)(i) gradually changes from the old spectrum coefficient sp-pre(i) to the new spectrum coefficient sp(i). (See FIG. 6.) In an interpolation operation period consisting of m frames, the selector 702 selects an interpolation spectrum coefficient sp-int(k)(i) under the control of the controller 703, and supplies it to the speech synthesis filter 4. In the other periods, the selector 702 selects a current frame spectrum coefficient sp(i) and supplies it to the speech synthesis filter 4.

When recognizing from the update signal Su that the background noise has been updated, the controller 703 makes the interpolation spectrum coefficient generator 701 calculate the interpolation spectrum coefficients and, at the same time, makes the selector 702 select the interpolation spectrum coefficients. When the interpolation operation period has been finished with a lapse of m frames from background noise updating, the controller 703 stops the interpolation spectrum coefficient generator 701 computing and makes the selector 702 select a current frame spectrum coefficient sp(i) .

Figure 4:
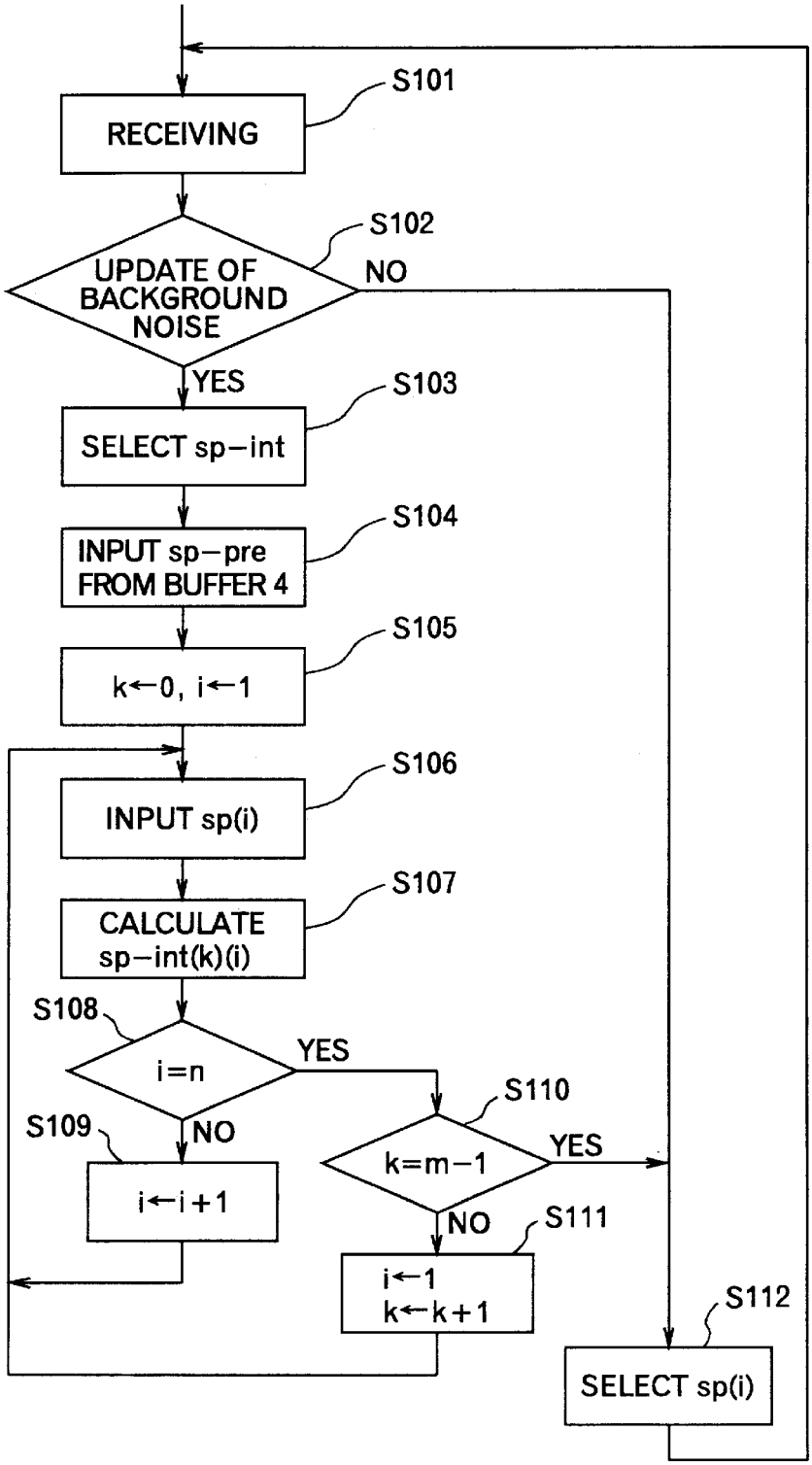
FIG. 4 is a flowchart showing an operation of the interpolation circuit of the embodiment.

Referring to FIG. 4, the operation of the interpolation circuit 7 will be described in detail. First, based on the update signal Su obtained by a receiving operation (S1O1) of the receiver system 1, the controller 703 determines whether the background noise has been updated (S102). If the decision in S102 is affirmative, the selector 702 is turned into an interpolation spectrum coefficient selection mode (S103), and an old (i.e., immediately prior frame) spectrum coefficient sp-pre(i) is transferred from the buffer 6 to the interpolation spectrum coefficient generator 701 (S104). Then, the controller 703 initializes values k and i, k indicating the frame number, and i indicating the degree of a spectrum coefficient (S105).

Then, receiving a new spectrum coefficient sp(i) (S106), the interpolation spectrum coefficient generator 701 calculates an interpolation spectrum coefficient sp-int(k)(i) according to the following equation (S107):

$$\text{sp-int}(k)(i)=w(k)(i)*\text{sp}(i)+\{1-w(k)(i)\}*\text{sp-pre}(i),$$

where w(k)(i) is a predetermined weight coefficient. If k=m−1, sp-int(m−1)(i)=sp(i) irrespective of the value of i.

Steps S106 and S107 are repeated until i becomes equal to n, i.e., for one frame (S108 and S109), generating n interpolation spectrum coefficients, sp-int(k)(1),sp-int(k)(2), . . . , spint(k)(n), of the frame k.

Figure 6:
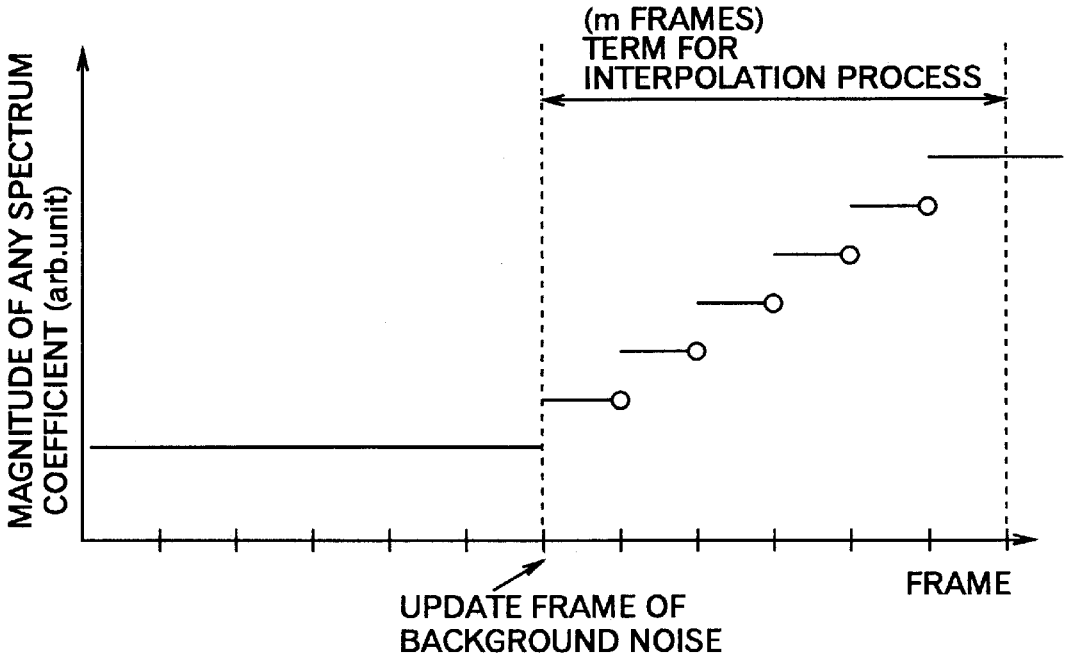
FIG. 6 is a graph showing a variation in the magnitude of a spectrum coefficient in the embodiment.

By repeating the above operation until k becomes equal to m−1, i.e., over m frames (S106–S111), the magnitude of any spectrum coefficient can be changed gradually as shown in FIG. 6 in the interpolation operation period. When a new spectrum coefficient sp(i) is reached (Yes in S110), the selector 702 is rendered into a mode of selecting a new spectrum coefficient sp(i) (S112), and the ordinary speech decoding operation is performed until next updating of background noise occurs (No in S102).

Figure 5:
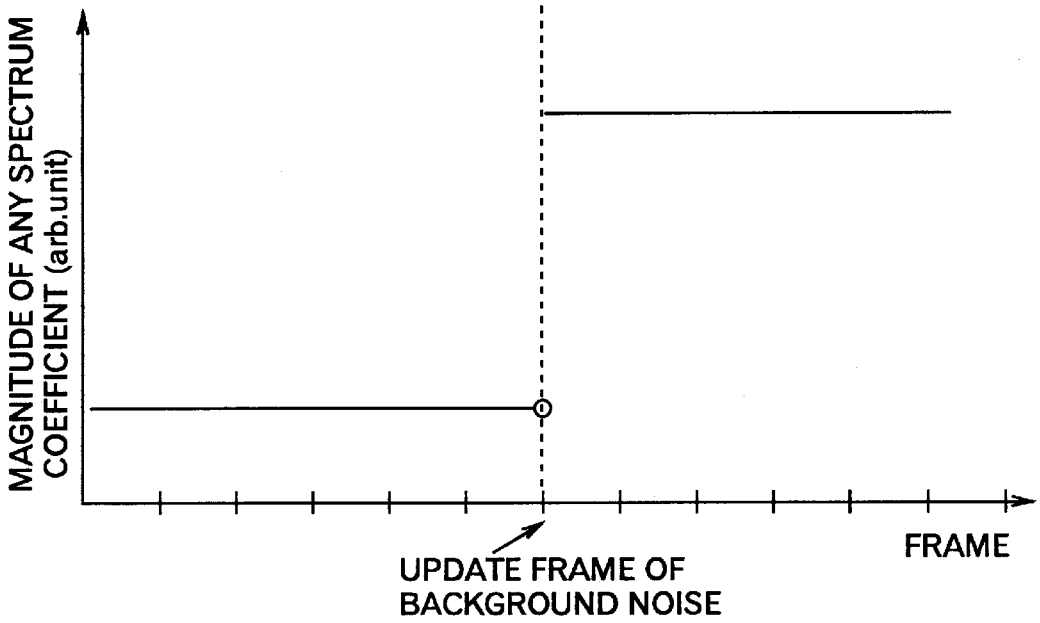
FIG.5 (PRIOR ART)
FIG. 5 is a graph showing a variation in the magnitude of a spectrum coefficient in the conventional speech decoder.

FIG. 5 shows how a speech spectrum coefficient varies in the conventional decoder and FIG. 6 how it varies in the decoder of the embodiment according to the invention. In the conventional case in which the received speech spectrum coefficients of background noise are used to update the background noise, the speech spectrum coefficient changes abruptly at the time of updating. On the other hand, in the embodiment in which the speech spectrum coefficient is gradually changed over several frames, a smooth change of background noise is obtained. As a result, it becomes possible to reduce the feeling of discomfort of the person on the receiving side stemming from an abrupt variation in magnitude of speech spectrum at the time of background noise updating.

We claim:

1. A speech decoding device for decoding received encoded signals in frames by using parameters obtained in frames based on the received encoded signals, any frame of the received encoded signals representing either speech or background noise, the background noise being updated at predetermined intervals, the speech decoding device comprising:

storage means for storing preceding parameters corresponding to the frame preceding a current frame; and linear interpolation means for generating interpolation parameters in frames over a predetermined period beginning from when the background noise is updated, the interpolation parameters changing in magnitude, according to a predetermined weighting function, from the preceding parameters stored in the storage means to the updated parameters corresponding to the current frame, said linear interpolation means including:

interpolation parameter generating means for generating the interpolation parameters over the predetermined period beginning from when the background noise is updated; and selecting means for selecting either the interpolation parameters or the parameters corresponding to the current frame, the interpolation parameters being selected during the predetermined period beginning from when the background noise is updated, the parameters corresponding to the current frame being selected during periods other than the predetermined period.

2. The speech decoding device as set forth in claim 1, wherein the storage means comprises a buffer memory of the first-in-first-out type.

3. A method for decoding received encoded signals in frames by using parameters obtained in frames based on the received encoded signals, any frame of the received encoded signals representing either speech or background noise, the background noise being updated at predetermined intervals, the method comprising the steps of:

(a) storing preceding parameters corresponding to the frame preceding a current frame;

(b) retrieving from storage stored preceding parameters when updated parameters are received in a current frame corresponding to when the background noise is updated; and (c) generating linear interpolation parameters in frames changing in magnitude, according to a predetermined weighting function, from the preceding parameters to the updated parameters over a predetermined period beginning from when the background noise is updated;

wherein said step (c) includes the steps:

(c1) selecting the linear interpolation parameters during the predetermined period beginning from when the background noise is updated; and (c2) selecting the parameters corresponding to a current frame during periods other than the predetermined period.

4. The method as set forth in claim 3, wherein the step of storing the preceding parameters employs first-in-first-out access scheme.

5. A speech decoding device for decoding received encoded signals in frames by using parameters obtained in frames based on the received encoded signals, any frame of the received encoded signals representing either speech or background noise, the background noise being updated with an update background noise frame at predetermined intervals, the speech decoding device comprising:

a memory, said memory having as an input preceding parameters corresponding to a frame of said encoded signals which precedes a current frame of said encoded signals; and a linear interpolation circuit, said linear interpolation circuit having as inputs current parameters corresponding to said current frame of said encoded signals, said preceding parameters output from said memory, and the update background noise frame, said interpolation circuit having output parameters as an output to be provided to a speech synthesis filter, wherein said linear interpolation circuit comprises:

an interpolation parameter generator which generates interpolation parameters over a predetermined period which begins at the moment the background noise is updated by receipt of said update background noise frame, said interpolation parameters changing in magnitude, over said predetermined period, according to a weighting function, from values of said preceding parameters to values of said current parameters; and a selector which receives as inputs said interpolation parameters and said current parameters, and having an output selected from between said interpolation parameters and said current parameters;

wherein the output of said selector is provided as the output parameters for the output of said linear interpolation circuit, and wherein said output parameters are said interpolation parameters during said predetermined period, and are said current parameters during all times other than said predetermined period.

6. The speech decoding device according to claim 5, wherein the interpolation parameters change in amplitude according to the function:

$$\text{sp-int}(k,i)=w(k,i)*\text{sp}(i)+\{1-w(k,i)\}*\text{sp-pre}(i)$$

wherein sp-int(k,i) corresponds to the interpolation parameters, sp(i) corresponds to the current parameters, sp-pre(i) corresponds to the preceding parameters, w(k,i) corresponds to the weighting function, k is a variable for specifying a particular frame during said predetermined period, and i is a variable for specifying a particular type of parameter among said parameters obtained in frames based on the received encoded signals.

7. The speech decoding device according to claim 5, wherein said memory is a buffer of the first-in-first-out type.

* * * * *